US005675838A

United States Patent [19]

Hollinger

[11] Patent Number: 5,675,838

[45] Date of Patent: Oct. 14, 1997

[54] CAMOUFLAGE CLOTHING

[76] Inventor: Brian L. Hollinger, 1024 N. 105th St., Omaha, Nebr. 68154

[21] Appl. No.: 670,817

[22] Filed: Jun. 25, 1996

[51] Int. Cl.[6] ..... A41D 1/00

[52] U.S. Cl. ..... 2/69; 23/900; 428/919; 36/113

[58] Field of Search ..... 2/69, 1, 900, 227, 2/115, 108, 79, 171, 173, 172, 202, 206, 209.12, 195; D2/718–720, 724, 861, 823–826, 830; 36/1, 83, 113; 428/919

[56] References Cited

U.S. PATENT DOCUMENTS

| | | | |
|---|---|---|---|
| D. 358,928 | 6/1995 | Slagle et al. | D2/830 |
| D. 363,811 | 11/1995 | Burrow | D2/830 |
| 4,517,230 | 5/1985 | Crawford | 428/919 |
| 4,656,065 | 4/1987 | Yacovella | 428/919 |

OTHER PUBLICATIONS

Cabela's —1994 Annual Fall Catalog; pp. 2, 3, 6, 13, 17, 18, 32, 38 and 48.

*Primary Examiner*—Gloria Hale

*Attorney, Agent, or Firm*—Zarley, McKee, Thomte Voorhees & Sease; Mark D. Frederiksen

[57] ABSTRACT

Camouflage clothing items include various clothing items having two different camouflage patterns thereon, a first pattern designed to blend with a proximal frame of reference, and a second pattern designed to blend with a background frame of reference. The proximal frame of reference is a vertically oriented object such as a tree having a diameter substantially in the range of six to eighteen inches. The first camouflage pattern extends vertically from a top to bottom end of the clothing items, and substantially across the width of the clothing item a distance substantially equal to the diameter of the proximal frame of reference object. Typical clothing items which utilize the dual camouflage patterns include a cap, shirt, pants, and boots.

11 Claims, 2 Drawing Sheets

CAMOUFLAGE CLOTHING

TECHNICAL FIELD

The present invention relates generally to clothing items having a camouflage pattern imprinted thereon, and more particularly to improved camouflage clothing having at least two different camouflage patterns imprinted on various portions thereof.

BACKGROUND OF THE INVENTION

Bow hunting has become an increasingly popular sport among game hunters. While there are many methods utilized in hunting, whether utilizing firearms, archery equipment, or other weapons, one common method of hunting calls for the hunter to choose a particular location and wait for the desired game to approach within striking distance.

One common piece of equipment in such hunting methods is a tree stand, which permits the hunter to wait, poised in a tree, above the ground. Because game can be very sensitive to movement of the hunter, camouflage patterns have been applied to various clothing items to assist the hunter in "blending in" with the surrounding environs.

The main problem with typical clothing items with a camouflage pattern lies in the fact that the pattern extends to all sides of the clothing. Thus, if the camouflage pattern includes brush, twigs and leaves, to hide the hunter while moving through a forest, the camouflage pattern is actually quite blatant when the hunter rests on a tree stand adjacent tree bark of a tree trunk. On the other hand, camouflage clothing having a tree bark design on all sides will only hide those portions of the hunter's body which fall within the confines of the tree trunk diameter. Since the conventional tree trunk upon which a tree stand is utilized has a diameter less than the diameter of the hunter's body, the hunter's arms and extreme sides will not be juxtaposed in front of the tree bark. Thus, the tree bark pattern would contrast with the background surround the tree trunk, thereby providing a visually detectable outline which could scare game.

SUMMARY OF THE INVENTION

It is therefore a general object of the present invention to provide a clothing item having two separate camouflage patterns thereon, one pattern matching a proximal frame of reference and the second pattern matching a background frame of reference.

Another object is to provide a dual pattern camouflage clothing item with a proximal frame of reference pattern imprinted on a forward portion of the clothing item, and the remainder of the clothing item imprinted with a background frame of reference pattern.

Still another object of the present invention is to provide a dual pattern clothing item which is simple to manufacture and permits a variety of different camouflage patterns thereon.

These and other objects will be apparent to those skilled in the art.

The camouflage clothing items of the present invention include various clothing items having two different camouflage patterns thereon, a first pattern designed to blend with a proximal flame of reference, and a second pattern designed to blend with a background frame of reference. The proximal frame of reference is a vertically oriented object such as a tree having a diameter substantially in the range of six to eighteen inches. The first camouflage pattern extends vertically from a top to bottom end of the clothing items, and substantially across the width of the clothing item a distance substantially equal to the diameter of the proximal frame of reference object. Typical clothing items which utilize the dual camouflage patterns include a cap, shirt, pants, and boots.

DESCRIPTION OF THE PREFERRED EMBODIMENT

Figure 1:
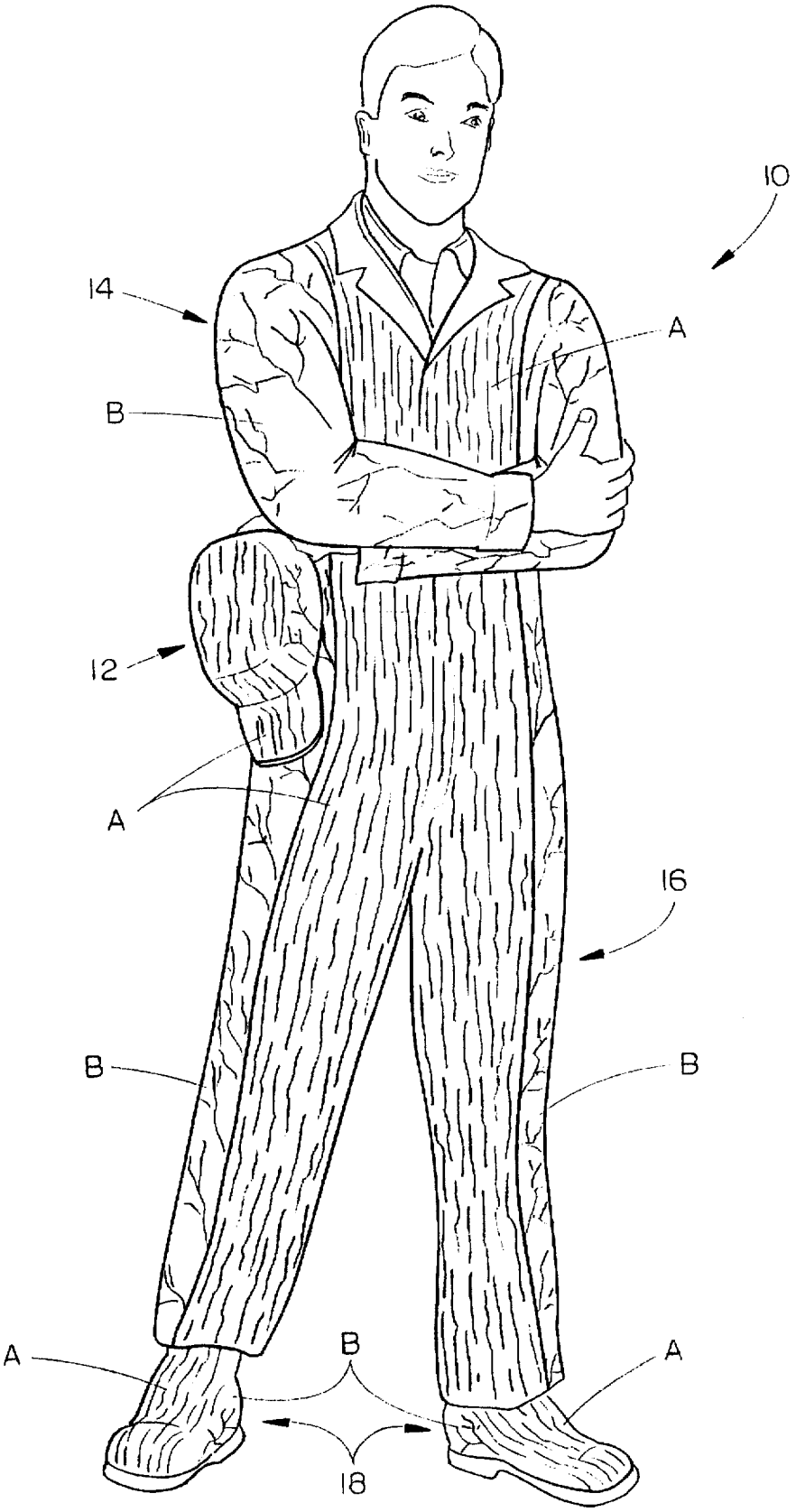
FIG. 1 is a pictorial view of a person wearing clothing items with the dual camouflage pattern of the present invention.

Referring now to the drawings, in which similar or corresponding parts are identified with the same reference numeral and more particularly to FIG. 1, the dual pattern clothing items of the present invention are identified generally at 10 and include a cap 12, a shirt 14, pants 16 and a pair of boots 18. Each clothing item 10 includes two distinct camouflage patterns **12*a* and 12*b*, 14*a* and 14*b*, 16*a* and 16*b*, and 18*a* and 18*b***, respectively.

Figure 3:
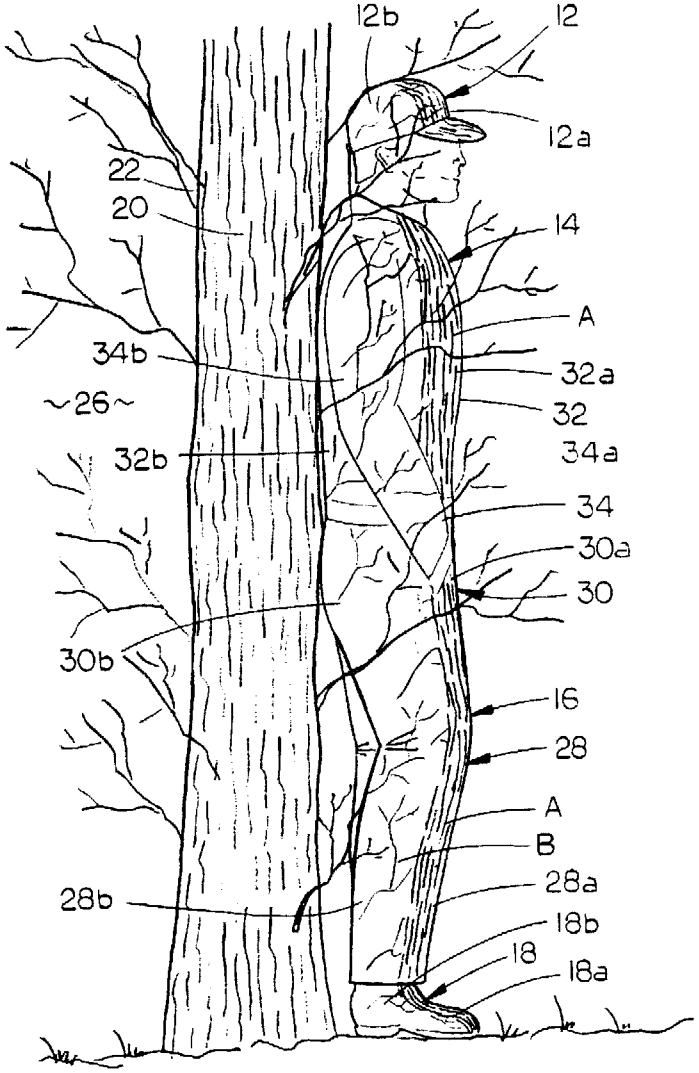
FIG. 3 is a side elevational view of the person shown in FIG. 2 with the clothing items of the present invention.
Figure 2:
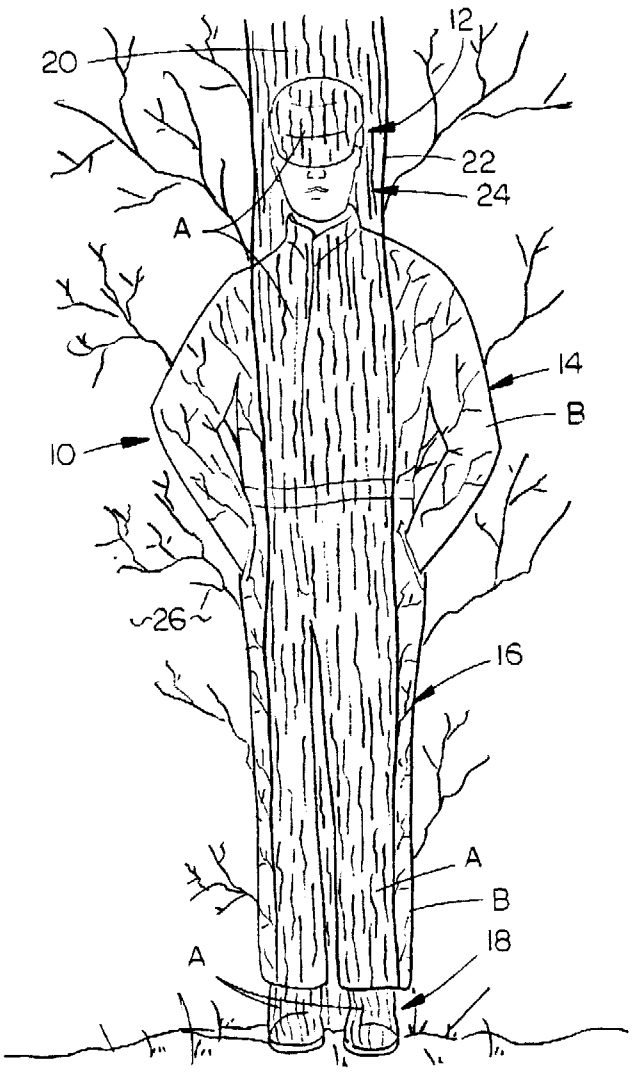
FIG. 2 is a front elevational view of a person with the clothing items of the present invention.

Referring now to FIGS. 2 and 3, the camouflage patterns imprinted on clothing items 10 relate directly to two individual flames of reference. More particularly, the proximal flame of reference is the bark pattern 20 of a tree trunk 22 against which the hunter 24 will stand or sit facing outwardly from tree trunk 22, awaiting game. A background frame of reference is identified generally at 26, and would conventionally include brush, twigs, and leaves of a color for the particular season and tree type in which the hunter would be stalking prey. Thus, if the hunter was hunting during winter, the background frame of reference 26 may include a white background with brown twigs and brush, without any leaves. On the other hand, if the hunter was hunting in a forest during summer the background frame of reference 26 would likely include a large amount of green of various tints and shades to match the foliage of surrounding brush and undergrowth.

As shown in FIGS. 2 and 3, the hunter 24 will conventionally spend the majority of hunting time perched in or adjacent a tree 22. In many cases, the hunter will sit on a tree stand (not shown) which is attached to the tree trunk 22 above the ground. While tree trunk diameters will vary considerably in a forest, there is a predetermined range of diameters upon which a tree stand may be easily mounted. This range is approximately six inches to eighteen inches in diameter, with the preferred diameter between ten and fourteen inches. For the average hunter, this means that the width of the torso would typically be equal to or less than the diameter of the tree trunk, while the arms would project outwardly beyond the average diameter of the tree trunk 22. In order to provide the best camouflage in front elevational view (as shown in FIG. 2) each clothing items would include the proximal frame of reference pattern A on those portions of the clothing items which would fall within the diameter of tree trunk 22 when viewed in forward elevation. For purposes of clarity of description, cap 12, shirt 14, pants 16, and boots 18, may be defined as formed of a forward panel and rearward panel connected together to create the body of each particular clothing item. In the case of cap 12, the proximal frame of reference camouflage pattern A would be imprinted on the entire forward panel **12*a*, while the background frame of reference camouflage pattern B would be imprinted on the entire rearward panel 12***b*. The same would be true of boots 18, wherein the entire forward panels 18*a* of boots 18 would have camouflage pattern A while the rearward panels 18*b* would have camouflage pattern B imprinted thereon.

Pants 16 include a pair of legs 28 having forward and rearward panels 28*a* and 28*b*, and a lower torso portion 30 having forward and rearward panels 30*a* and 30*b*. The forward panels 28*a* and 30*a* of legs and lower torso portions 28 and 30 would have camouflage pattern A, while the rearward panels 28*b* and 30*b* would have camouflage pattern B.

Finally, shirt 14 includes a torso portion 32 having forward and rearward panels 32*a* and 32*b* respectively, and arm portions 34 having forward and rearward panel portions 34*a* and 34*b*. For the average adult, torso portion front panel 32*a* would have camouflage pattern A, while torso portion rearward panel 32*b* and both forward and rearward panels 34*a* and 34*b* of the arm portions would all have camouflage pattern B. Smaller clothing sizes, for children or hunters having a smaller stature would find that the arms 34 of shirt 14 would fit within the diameter of tree trunk 22 when viewed in front elevation. In such a case, arm portions 34 would have camouflage pattern A on the front panels 34*a*, and camouflage pattern B on the rearward panels 34*b*.

Whereas the invention has been shown and described in connection with the preferred embodiment thereof, many modifications, substitutions and additions may be made which are within the intended broad scope of the appended claims.

I claim:

1. A clothing item having two different camouflage patterns, a first pattern designed to blend with a predetermined proximal frame of reference, and a second pattern designed to blend with a predetermined background frame of reference, the first pattern extending across only a first portion of the clothing item and the second pattern extending across only a second portion of the clothing item, the first and second portions being separate from one another and each of said first and second portions extending completely from a top edge to a bottom edge of the clothing item such that the first and second patterns do not overlap.

2. The clothing item of claim 1, wherein said clothing item includes a forward panel and a rearward panel connected together to form a clothing item fitting a portion of a human body, and wherein said first pattern of the clothing item first portion includes extends across at least a portion of the forward panel.

3. The clothing item of claim 2, wherein the first pattern is an imprinted design of a vertically oriented object having a width generally in the range of six to eighteen inches.

4. The clothing item of claim 3, wherein the first pattern extends vertically from a top to a bottom end of the forward panel and extends a width generally in the range of six to fourteen inches.

5. The clothing item of claim 2, wherein the clothing item is an item for covering a human head, and wherein the first pattern is an imprinted design of a vertically oriented object and extends across the entirety of the forward panel.

6. The clothing item of claim 2, wherein the clothing item is an item for covering a human foot, and wherein the first pattern is an imprinted design of a vertically oriented object and extends across the entirety of the forward panel.

7. The clothing item of claim 4, wherein the clothing item is a shirt having a torso portion with forward and rearward panels and a pair of arm portions each having forward and rearward panels, wherein the first pattern extends vertically for the entire extent of the torso portion and at least a majority of a width of the torso portion, and wherein the second pattern extends across the entirety of the, forward and rearward panels of the arm portions.

8. The clothing item of claim 4, wherein the clothing item is a pair of pants having a torso portion with forward and rearward panels and a pair of leg portions each having forward and rearward panels, wherein the first pattern extends vertically for the entire extent of the torso portion and leg PORTIONS, and at least a majority of a width of the torso and leg portion forward panels.

9. The clothing item of claim 2, wherein the first pattern is a tree bark pattern.

10. The clothing item of claim 9, wherein the first pattern is an imprint of a tree having a width substantially in the range of six to eighteen inches.

11. The clothing item of claim 3, wherein the vertically oriented object has a width of between ten to fourteen inches.

* * * * *